US006335975B1

(12) United States Patent
Yang

(10) Patent No.: US 6,335,975 B1
(45) Date of Patent: Jan. 1, 2002

(54) RAINPROOF AND OMNIDIRECTIONAL LOUDSPEAKER SYSTEM

(75) Inventor: Tony Yang, Taichung (TW)

(73) Assignee: Sekaku Electron Industry Co., Ltd., Taichung (TW)

( * ) Notice: Subject to any disclaimer, the term of this patent is extended or adjusted under 35 U.S.C. 154(b) by 0 days.

(21) Appl. No.: 09/765,402

(22) Filed: Jan. 22, 2001

(51) Int. Cl.[7] ..... H04R 1/02

(52) U.S. Cl. ..... 381/386; 381/332; 381/182; 381/390

(58) Field of Search ..... 381/386, 182, 381/87, 332, 336, 335, 387, 390; 181/199

(56) References Cited

U.S. PATENT DOCUMENTS 4,908,601 A * 3/1990 Howze
4,953,223 A * 8/1990 Householder
5,115,882 A * 5/1992 Woody .....

* cited by examiner

*Primary Examiner*—Sinh Tran
(74) *Attorney, Agent, or Firm*—Browdy and Neimark

(57) ABSTRACT

A rainproof and omnidirectional loudspeaker system comprises a base set, a plurality of fitting ring sets, at least one speaker, and an upper cover set. The fitting ring sets are stacked together on the base set. The fitting ring sets have a ring cover, which is provided with a through hole and a ring portion. The two adjoining ring covers are provided with a plurality of partitions disposed therebetween. Two partitions are provided with an empty portion located therebetween. The empty portion is shielded by the ring portion of the ring cover. The speaker is mounted in one of the fitting ring sets. The upper cover set is disposed on the topmost fitting ring set. The sound waves produced by the speaker are radiated into air in all directions via the through holes of the fitting ring sets and the empty portions. The ring covers serve to prevent intrusion of rain or foreign objects.

11 Claims, 6 Drawing Sheets

RAINPROOF AND OMNIDIRECTIONAL LOUDSPEAKER SYSTEM

FIELD OF THE INVENTION

The present invention relates generally to a loudspeaker, and more particularly to a rainproof and omnidirectional loudspeaker system.

BACKGROUND OF THE INVENTION

The conventional omnidirectional loudspeaker system is generally formed of a plurality of speakers, which are gather in a cluster on a support frame. In light of each speaker radiating sound waves at a predetermined angle, the conventional omnidirectional loudspeaker system is ineffective at best. In addition, the conventional loudspeaker system is not rainproof.

SUMMARY OF THE INVENTION

The primary objective of the present invention is to provide a state-of-the-art omnidirectional loudspeaker system.

It is another objective of the present invention to provide an omnidirectional and rainproof loudspeaker system.

The loudspeaker system of the present invention comprises a base set, a plurality of fitting ring sets mounted on top of the base set. Each fitting ring set has a ring cover forming a through hole and a ring portion. A plurality of partitions are disposed between the two adjoining ring covers. An empty portion is located between two partitions. The ring portion of the ring cover is extended to shield the empty portion. At least one speaker is mounted in one fitting ring set. The topmost fitting ring set is provided with an upper cover set. The sound waves are radiated into air in all directions via the through holes of the fitting ring sets and the empty portions. The rainproof effect is provided by the ring covers of the fitting ring sets.

DETAILED DESCRIPTION OF THE INVENTION

Figure 1:
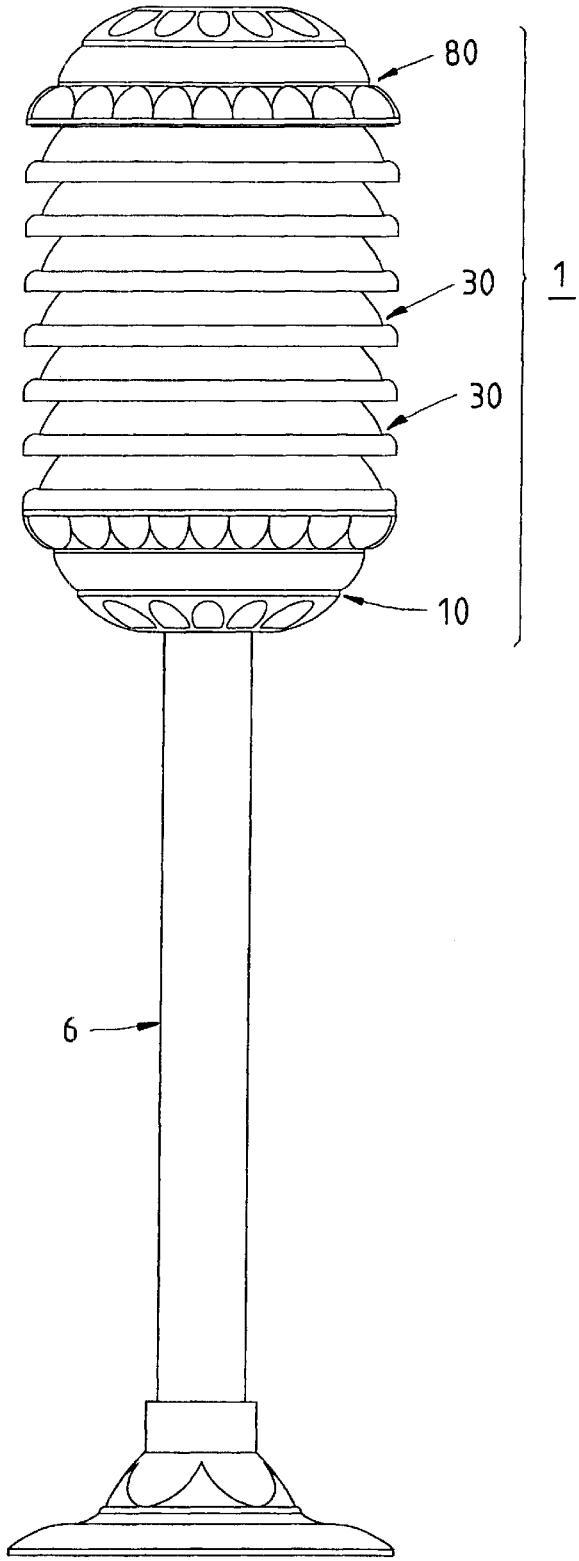
FIG. 1 shows a side plan view of a preferred embodiment of the present invention.

As shown in FIG. 1, a loudspeaker system 1 embodied in the present invention is mounted on a lower support rod 6 which is formed of a base seat 6A and an upright tube 6B. The loudspeaker system 1 of the present invention is rainproof and omnidirectional.

Figure 2:
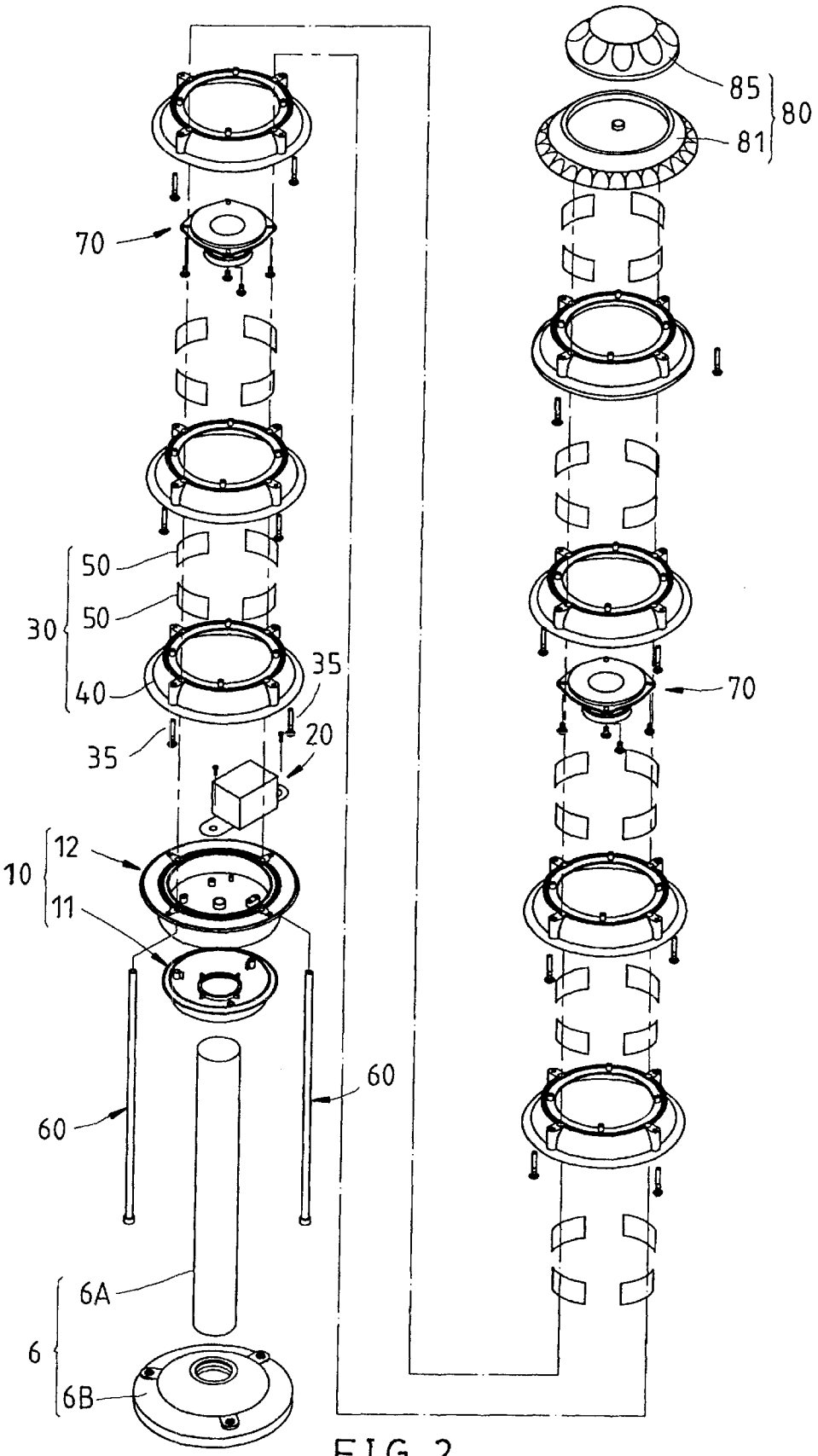
FIG. 2 shows an exploded view of the preferred embodiment of the present invention.
Figure 3:
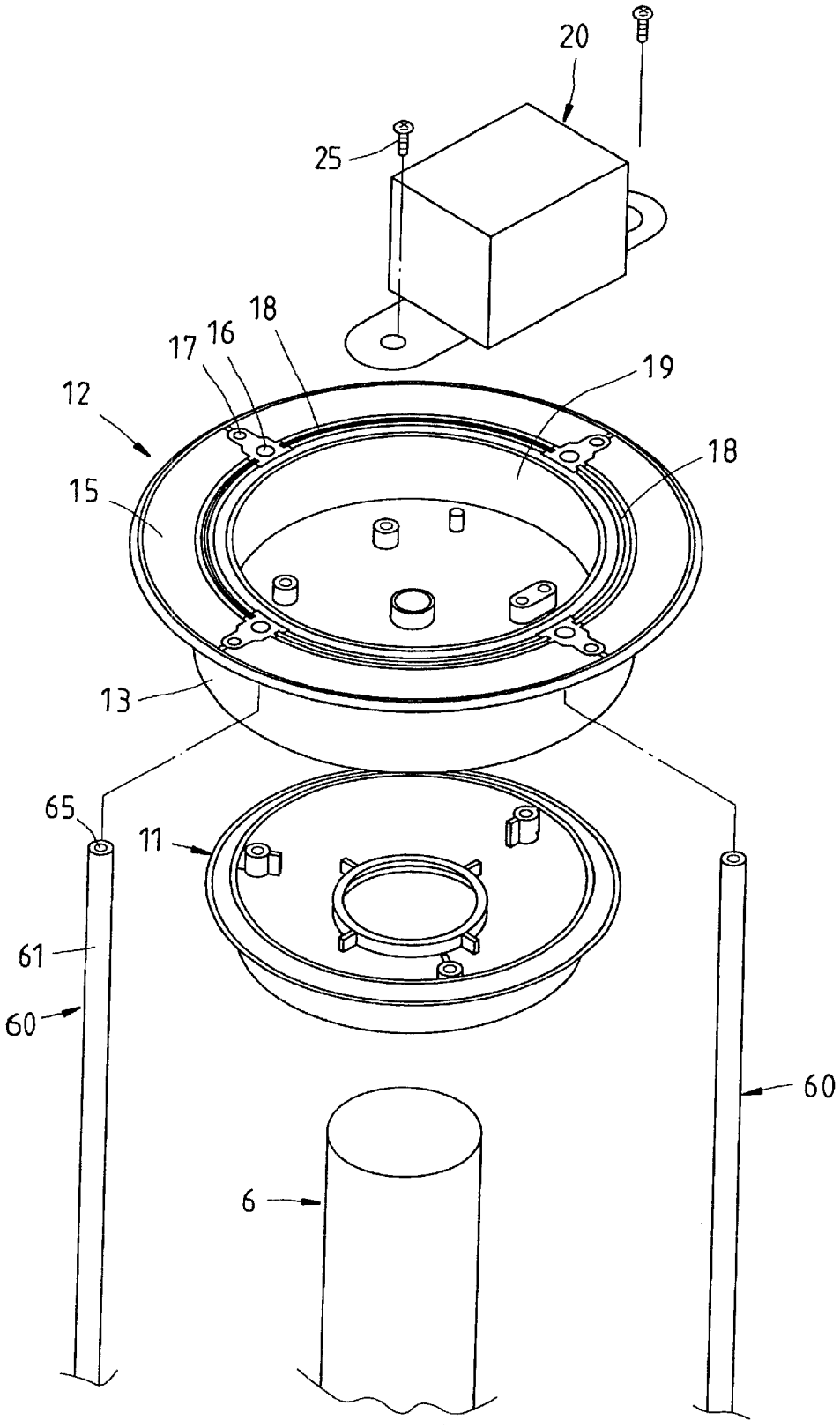
FIG. 3 shows a partial exploded view of the preferred embodiment of the present invention.
Figure 4:
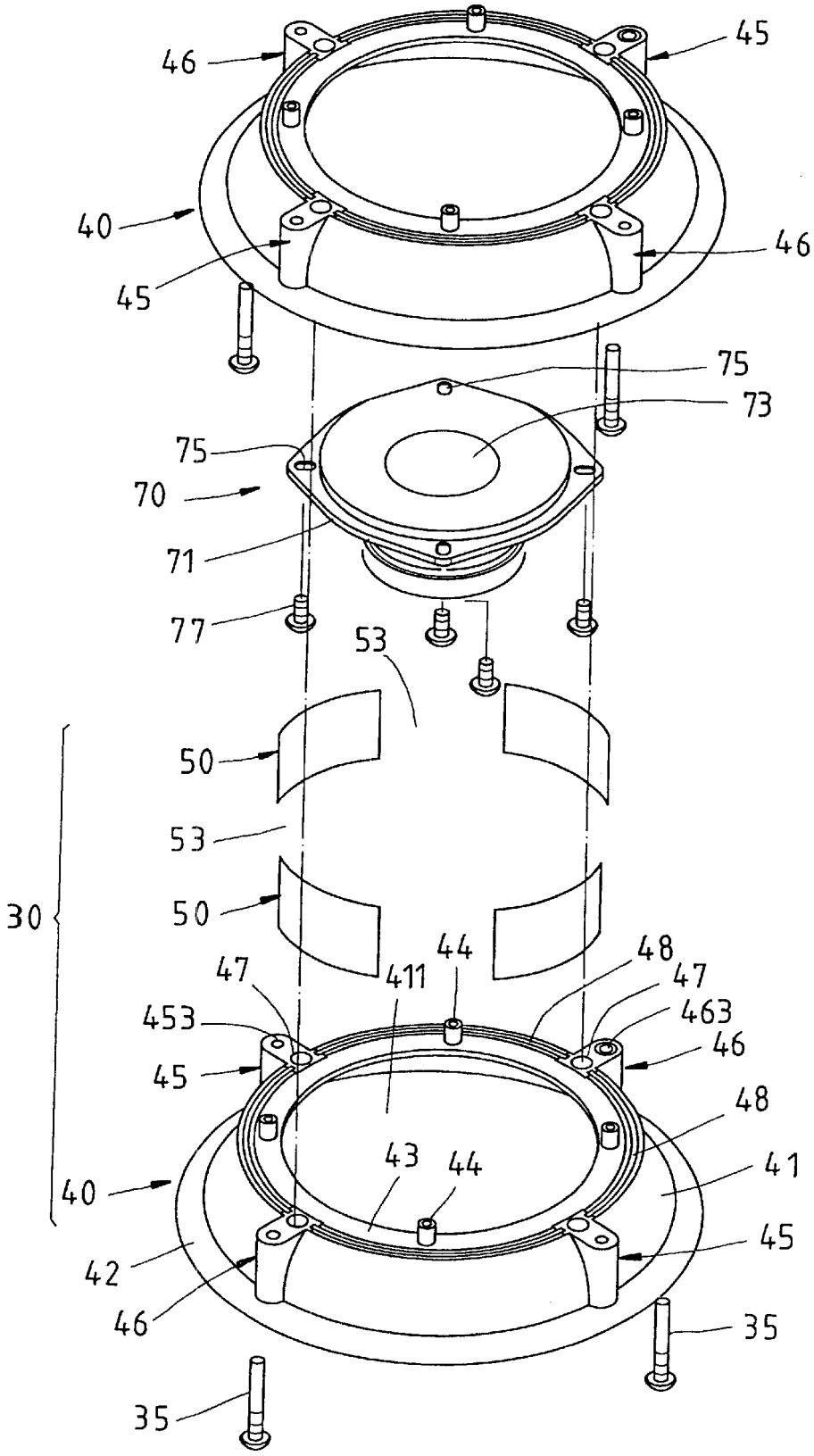
FIG. 4 shows another partial exploded view of the preferred embodiment of the present invention.

As shown in FIGS. 2–4, the loudspeaker system 1 of the present invention comprises the component parts, which are described hereinafter.

A base set 10 has a pillar connecting disk 11 for fastening the lower support rod 6, and a seat body 12 mounted on the pillar connecting disk 11. The seat body 12 is formed of a disk portion 13 which is provided with a connection edge 15 which is in turn provided with four rod holes 16 and four fastening holes 17 arranged equiangularly. The connection edge 15 is further provided with four annular slots 18 and a receiving portion 19.

A controller 20 is used for power source input and is fastened with the receiving portion 19 of the base set 10 by a plurality of bolts 25.

A plurality of fitting ring sets 30 are provided with a ring cover 40 and four sets of partitions 50 mounted on the ring cover 40. The lowest fitting ring set 30 is disposed on the base set 10.

As shown in FIG. 4 the ring cover 40 has an arcuate ring portion 41 which is provided with a through hole 411. A cover edge 42 is connected with the bottom edge of the ring portion 41. A speaker fastening edge 43 is formed on the top edge of the ring portion 41 and is provided with four threaded holes 44. Two first fastening portions 45 and two second fastening portions 46 are provided with a rod hole 47. The first fastening portions 45 are provided with a fastening hole 453. The second fastening portions 46 are provided with a threaded hole 463. Four annular slots 48 are provided for insertion of the partitions 50.

Two ring covers 40 are mounted at an angle of 90 degrees. Two bolts 35 are engaged with the threaded holes 463 of the upper ring cover 40 via the fastening holes 453.

Two fastening rods 60 are put through the rod holes 16 of the base set 10 and the rod holes 47 of the ring covers 40 of each fitting ring set 30, so as to provide a fastening action and a supporting action. The fastening rods 60 have a rod body 61, a head 63, and a threaded hole 65.

Two speakers 70 are provided with a fastening portion 71 mounted on the speaker fastening edge 43 of two fitting ring sets 30, a sound producing body 73 disposed on the fastening portion 71, four inner holes 75 through which the bolts 77 are engaged with the threaded holes 44 of the ring cover 40 of each fitting ring set 30. The sound producing direction of the sound producing body 73 is upward.

An upper cover set 80 is formed of a cover disk 81 and a top disk 85 disposed on the cover disk 81. The upper cover set 80 is disposed on the topmost fitting ring set 30. The cover disk 81 is similar in size to the ring portion 41.

As shown in FIG. 1, the loudspeaker system 1 is mounted on the lower support rod 6 in a park.

In combination, an empty portion 53 is formed between the partitions 50 of the fitting ring sets 30. The partitions 50 may be used to dispose another ring cover 40. The ring portion 41 and the cover edge 42 of each ring cover 40 form a predetermined angle to shield the empty portion 53 of the fitting ring set 30.

Figure 5:
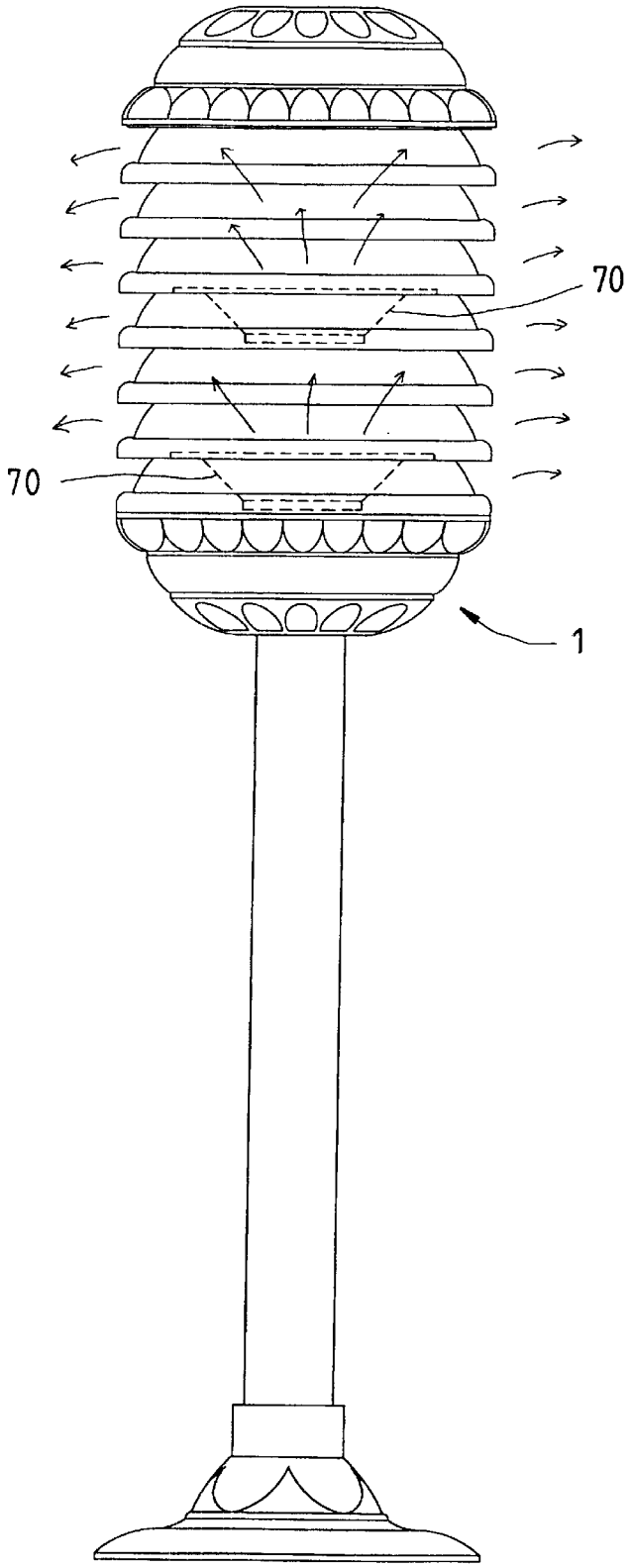
FIG. 5 shows a side schematic view of the preferred embodiment of the present invention.

As shown in FIG. 5, the system can be fixed by the base set 10 or the upper cover set 80. The speaker 70 sends out axially the sound waves, which are radiated into air in all directions via the through holes 411 of the ring covers 40 and the empty portions 53.

Figure 6:
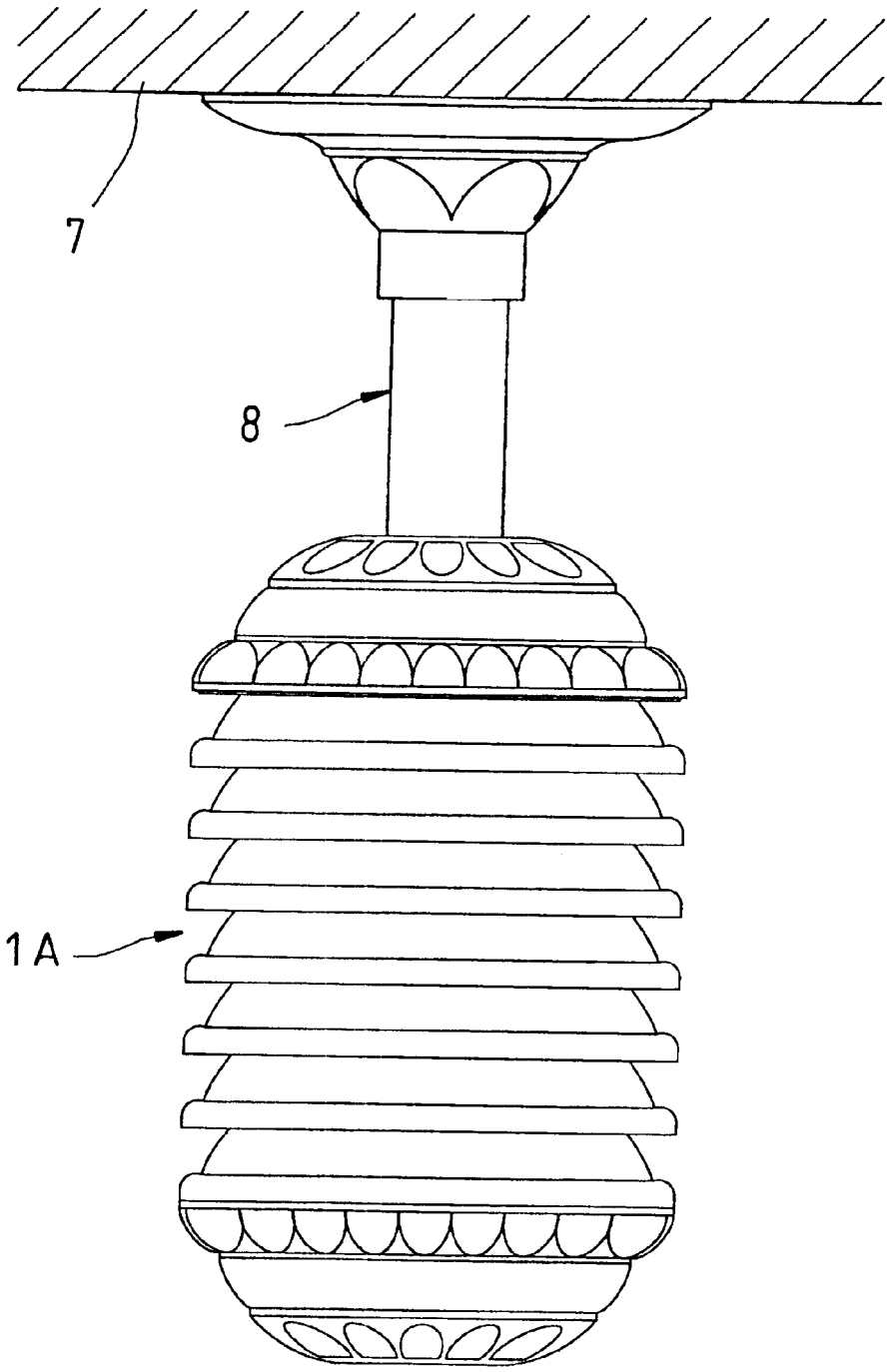
FIG. 6 shows a schematic view of the preferred embodiment of the present invention in use.

The positions of the ring portions 41 and the cover edge 42 of each fitting ring set 30 are lower in relation to the partition 50 and the empty portions 53, so as to prevent intrusion of rain or foreign object. As shown in FIG. 6, a system 1A of another preferred embodiment of the present invention is mounted on a fastening rod 8, so as to hang the system 1A from a ceiling 7.

The ring cover of each fitting ring set of the present invention may be of any shape, as long as it is provided with a stop edge to shield the empty portion of the fitting ring set. The partitions may be provided with sound holes to enhance the radiating effect of the sound waves. The speaker 70 may face upward or downward.

What is claimed is:

1. A rainproof and omnidirectional loudspeaker system comprising:

a base set having a seat body;

a plurality of fitting ring sets stacked together such that a lowest fitting ring set is mounted on said base set, each of said fitting ring sets having a ring cover which is provided with a through hole and a ring portion, two adjoining ring covers being provided therebetween with a plurality of partitions, an empty portion being formed between two partitions, said empty portion being shielded by said ring portion of said ring cover;

at least one speaker disposed in one of said fitting ring sets; and an upper cover set mounted on a topmost fitting ring set;

sound waves produced by said speaker being radiated into air in all directions via said through holes of said fitting ring sets and said empty portions, said ring covers of said fitting ring sets intended to prevent intrusion of rain or foreign objects.

2. The loudspeaker system as defined in claim 1 further comprising two fastening rods and two rod holes located in said ring cover to receive said fastening rods.

3. The loudspeaker system as defined in claim 1, wherein said ring covers are provided with two fastening holes and two threaded holes; wherein two adjoining ring covers are fastened by two bolts which are engaged with said threaded holes via said fastening holes.

4. The loudspeaker system as defined in claim 1, wherein said ring covers are provided with an annular slot; wherein said partition is inserted into said annular slot.

5. The loudspeaker system as defined in claim 1, wherein said ring covers are provided with a speaker fastening edge for mounting said speaker.

6. The loudspeaker system as defined in claim 1, wherein said speaker is two in number.

7. The loudspeaker system as defined in claim 1, wherein said base set is fastened with a support rod.

8. The loudspeaker system as defined in claim 1, wherein said upper cover set is fastened with a support rod.

9. The loudspeaker system as defined in claim 1, wherein said partitions are provided with at least one sound hole.

10. The loudspeaker system as defined in claim 1, wherein said speaker radiates sound waves in a direction toward said upper cover set.

11. The loudspeaker system as defined in claim 1, wherein said speaker radiates sound waves in a direction toward said base set.

* * * * *